US005573351A

United States Patent [19]

Beamer

[11] Patent Number: 5,573,351

[45] Date of Patent: Nov. 12, 1996

[54] METHOD AND APPARATUS FOR RELINING OR FORMING A TRENCH

[75] Inventor: John V. Beamer, Atlanta, Ga.

[73] Assignee: Hoosier Group, L.L.C., Atlanta, Ga.

[21] Appl. No.: 287,654

[22] Filed: Aug. 9, 1994

[51] Int. Cl.[6] ..... E02B 5/00

[52] U.S. Cl. ..... 405/119; 249/11; 404/2; 404/4; 405/118; 405/121

[58] Field of Search ..... 405/118–121, 126; 404/2, 4, 25, 26

[56] References Cited

U.S. PATENT DOCUMENTS

| | | | |
|---|---|---|---|
| 4,940,359 | 7/1990 | Van Duyn et al. | 405/126 X |
| 4,993,877 | 2/1991 | Beamer . | |
| 4,993,878 | 2/1991 | Beamer . | |
| 5,066,165 | 11/1991 | Wofford et al. | 404/4 X |
| 5,181,793 | 1/1993 | Dekel | 404/4 |
| 5,213,438 | 5/1993 | Barenwald | 405/118 X |
| 5,256,000 | 10/1993 | Beamer . | |
| 5,281,052 | 1/1994 | Beamer . | |
| 5,326,189 | 7/1994 | Beamer . | |
| 5,326,190 | 7/1994 | Beamer . | |

*Primary Examiner*—Dennis L. Taylor
*Attorney, Agent, or Firm*—Needle & Rosenberg, P.C.

[57] ABSTRACT

A trench liner system used for lining a single containment trench and for forming a dual containment trench from a single containment trench comprising a primary liner means within the trench supported by a separating means between the primary liner and the trench walls and bottom, and a means for holding the primary liner means and the separating means to the trench walls. The separating means comprises a plurality of pairs of elongated members disposed along the trench such that the rear surface of each elongated member is in contact with one wall of the trench and the underside surface of each member is in contact with the bottom of the trench. The elongated members are in opposed relationship to each other. The length of the lower portion of each elongated member is less than one-half the width of the bottom of the trench so that a gap is formed between the distal edges of the lower portions to position therein a means for detecting a leak in the primary liner. The separating means also includes a perforated bridge in contacting relationship with the distal edges of the opposed elongated members. The separating means comprises a plurality of ribs spaced along each elongated member, so that the primary liner means is supported by the ribs and a cavity is formed between the primary liner means and the separating means between the ribs.

11 Claims, 6 Drawing Sheets

METHOD AND APPARATUS FOR RELINING OR FORMING A TRENCH

BACKGROUND OF THE INVENTION

1. Field of the Invention

The present invention relates to the construction industry and, more specifically, to the formation of a trench lining system which can renew a system that is wearing or worn out, that can turn an in-place trench into a dual containment trench system, that may be used in new construction to form a trench resistant to a wide variety of chemicals as either single or dual containment at a much lower cost than prior systems.

2. Description of the Prior Art

The general concept of trench drainage has long been used. Trenches are used where liquid run-offs occur, such as chemical plants, food processing operations, pulp and paper mills, pharmaceutical manufacturing, bottling plants, in parking garages and parking areas of shopping centers. The fluid from a trench generally goes into a catch basin or sewer large enough to release the material from the trench as it arrives. The top of the trench is normally covered with a slotted grate to allow entrance of the fluids, catching of debris, load carrying capacity for whatever may pass over it and, in some applications, they are solidly covered, such as crossing sidewalks or where conduits are carried within the trench and fluid entry is minimal and not necessarily desirable.

In the prior art, worn out trenches had to be completely removed by cutting the surrounding concrete, removing all brick linings when present, removing the frames and effectively then starting over again to build a new trench. In the prior art, there was no way to convert an existing trench into a dual containment trench, or to build a trench by conventional ways and at the same time turn it into a dual containment trench.

Thus, there exists a word-wide need for an economical method to line a trench.

There also exists a need for an economical way to construct a dual containment trench.

There also exists a need for a system to line a trench without replacing it in its entirety.

There also exists a need for a system to convert a trench from a single containment to a dual containment system.

There also exists a need to provide a means to build a trench by conventional means and subsequently turn it into a dual containment system.

There also exists a need for a system which can be rapidly installed decreasing plant down time.

SUMMARY OF THE INVENTION

The disadvantages of the prior art are overcome by the present invention, which relates to a grate or solid covered trench to be replaced or constructed by conventional means.

The trench liner system of the present invention is used for forming a dual containment trench and for lining a trench. It comprises a primary liner means extending along the length of the trench, a separating means disposed between the primary liner means and the trench walls and trench bottom, and a means for holding the primary liner means and the separating means to the trench walls.

The separating means comprises a plurality of pairs of elongated members. Each elongated member comprises an upright portion and a lower portion horizontally extending from the bottom of the upright portion and terminating in a distal edge. The elongated members are disposed along the trench such that the rear surface of each elongated member is in contact with one wall of the trench and the underside surface of each member is in contact with the bottom of the trench. The distal edges of each of the pairs of elongated members are in opposed relationship. The separating means also includes a perforated bridge in contacting relationship with the distal edges of the opposed elongated members.

The length of each lower portion is less than one-half the width of the bottom of the trench so that a gap is formed between the distal edges of the lower portions. The separating means is capable of being in fluid communication through the perforated bridge with the gap. A means for detecting fluid flowing into the gap through the holes, such as an electronic fluid sensor, may be placed in the gap or attached to the underside of the bridge or at low points in the trench.

The separating means may comprise a plurality of ribs spaced along the wall of the separating means, so that the primary liner means is supported by the ribs and a cavity is formed between the primary liner means and the separating means between the ribs. An alternative means includes a plurality of ribs spaced along the exterior surface of the primary liner means instead of the separating means. In this embodiment, the ribs are positioned horizontally along the exterior surface of the primary liner means and should have a plurality of openings in them to allow for the downward flow of fluid into the cavity. In this embodiment, the primary liner means may comprise an extruded plastic sheet or other materials placed onto the separating means.

The holding means comprises an anchor member affixed to the upper portion of the existing trench wall, a frame removably attached to the anchor member and overlying the upper portion of the primary liner means and the separating means, and a means for attaching the frame to the anchor member. The anchor member has a planar portion and leg members depending from the planar portion which engage the top of the wall of the existing trench. The frame comprises a Z-shaped member having a horizontal section with first and second opposed sides. The first side terminates in a depending portion and the second side terminates in an upright portion. The horizontal section overlies the planar portion of the anchor member and the depending portion overlies the upper portion of the liner.

Another frame design, essentially the same as disclosed in U.S. Pat. Nos. 4,993,877; 4,993,878; 5,000,621; 5,256,000; and 5,281,052, may be used. In this embodiment, each of the frames may include an adjustable anchoring means to position the frame to the proper elevation before pouting concrete or other materials. A piece of hanger material, such as a wooden 4×4, or a steel channel may be placed across the trench at various points along the trench. The frames are suspended from the hangar material using wire or nuts and bolts to hold the frames at the proper finished elevation.

In an alternative preferred embodiment, the holding means is substantially U-shaped and comprises a horizontal member with a first wall depending from one end and a second wall depending the other end. The top surface of the trench wall has an opening therein to receive a portion of the first depending wall. The second depending wall overlies the upper portion of the liner.

The trench containment unit is extremely flexible in allowing a continuous primary liner means with no joints for two hundred feet or more. The trench containment unit should be an unbroken unit as long as possible to minimize the number of joints which might leak. The primary liner means can be neutral or sloping as needed. Where long trenches occur, there may be expansion of the trench walls beyond the length of the frames. This expansion must be unimpeded but accommodations for added length, turns, and intersections may be added as needed.

To form a place for the new frame, the concrete or other material must be cut behind and under the current trench frame far enough for the new frame to fit and be held securely once the frame is in place. Once accomplished, the frame may be removed from its anchor plates (although it does not have to be). Once removed, the new separating means and perforated bridge are installed and the primary liner means is then placed snugly inside the separating means. The top of the primary liner means and the separating means are placed snugly behind the lower part of the frame. Sealants may be used between the frame and the concrete, behind the bolts securing the frame to its base, and between frame sections.

Expansion and contraction will be accommodated by the design of the wall ribs or by the methods used in U.S. Pat. Nos. 5,256,000 and 5,281,052.

It is an object of the present invention to provide an improved containment trench.

It is also an object of the preset invention to provide a means to renew a trench without replacing it in its entirety.

It is also an object of the present invention to provide a means to convert an existing trench from a single containment system to a dual containment system.

These and other objects will become apparent from the following description of the preferred embodiment taken in conjunction with the following drawings, although variations and modifications may be effected without departing from the spirit and scope of the novel concepts of the disclosure.

DETAILED DESCRIPTION OF THE PREFERRED EMBODIMENTS

Figure 1:
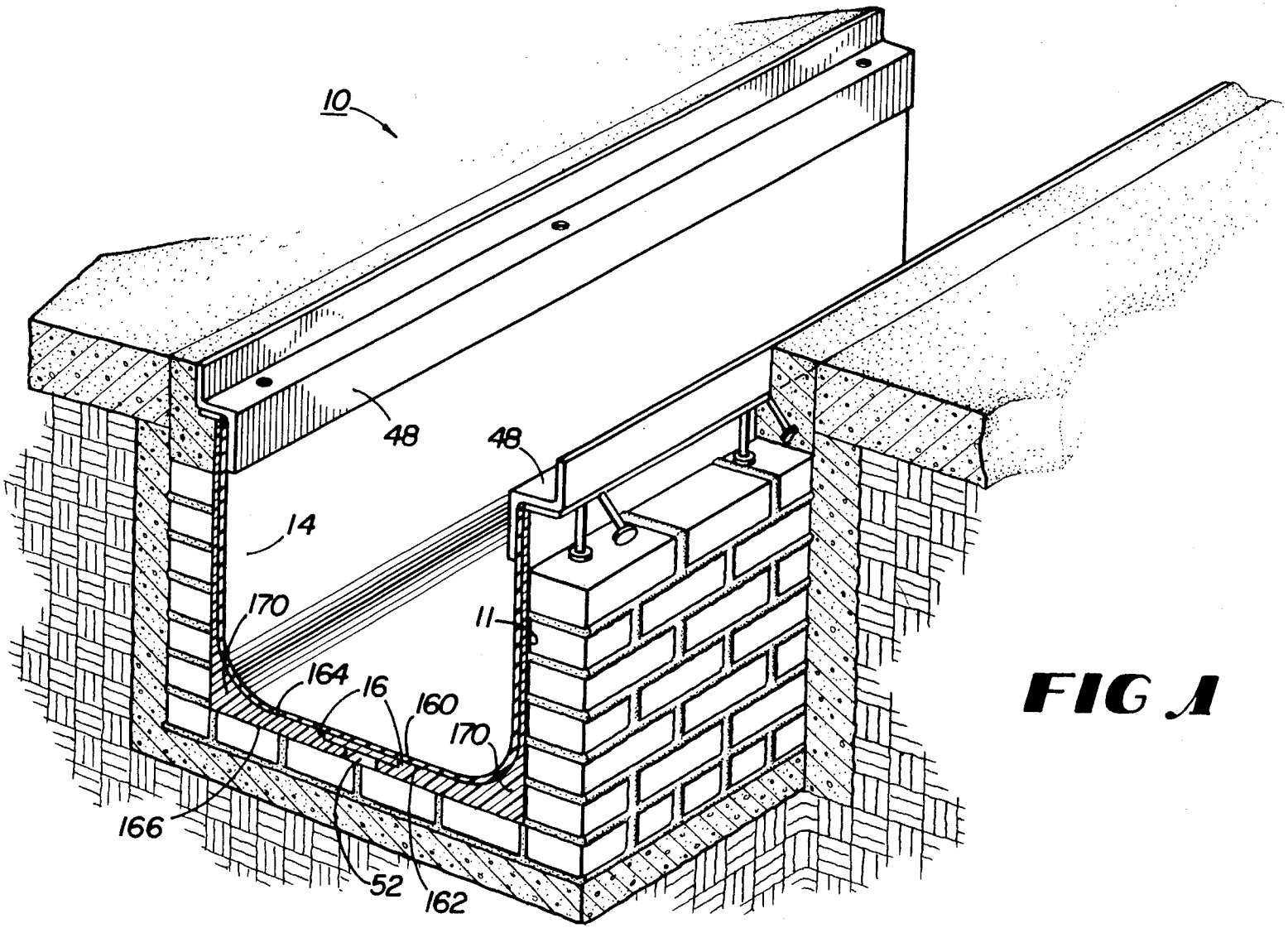
FIG. 1 is a perspective view of a trench assembly of the present invention having a multi-walled design.

Referring to FIG. 1, a preferred embodiment of the present invention 10, a multiwalled trench, is shown. It comprises a separating means 16 which rests within a trench 11 having two opposed vertical walls and a bottom. The separating means 16 has a first surface 164 open to the interior of the trench and an opposed second surface 166 and it extends along the length of the trench. The separating means 16 run along the length of the trench, one on each side, and in opposed relation to each other. The present invention 10 also comprises a primary liner means 14, having an interior surface 160 and an exterior surface 162, disposed along the length of the trench, supported by the separating means 16.

The primary liner means 14 comprises a material (e.g. fiberglass, plastic, stainless steel, coated steel, or any other formable material) that is resistant to the fluids which the trench is designed to hold. The primary liner means 14 and the separating means 16 are affixed to the existing trench wall 11 with a means for holding 48 the primary liner means 14 and the separating means 16 to the trench wall. The primary liner means 14 is not attached to the separating means 16, allowing the primary wall 14 and the separating means 16 to expand and contract along their lengths independently from each other.

This also allows for the easy removal and replacement of the holding means 48, the primary liner means 14 and the separating means 16.

Figure 2:
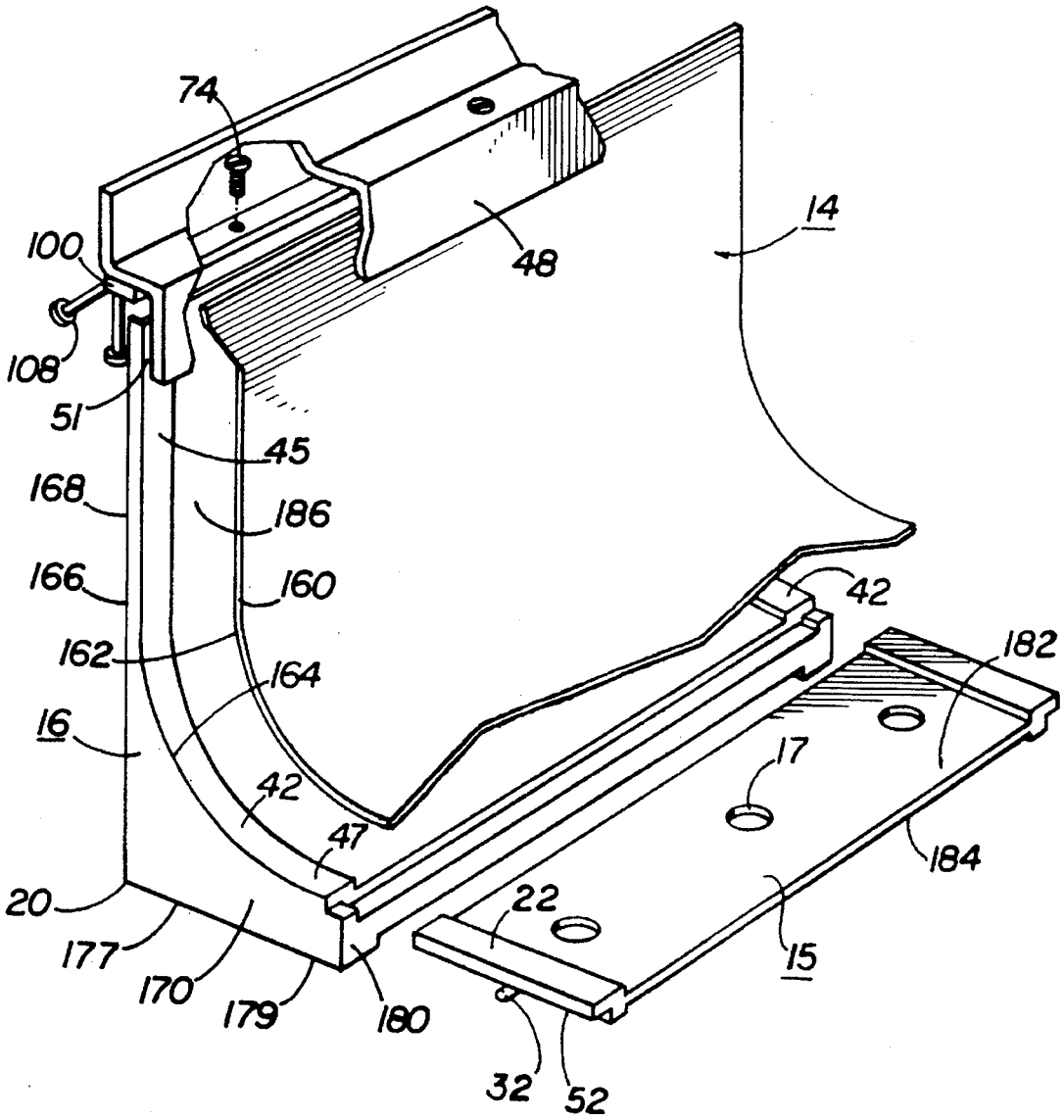
FIG. 2 is a partial cross-sectional and perspective view of the lined trench in accord with the present invention.

Referring to FIGS. 1 and 2, the separating means 16 comprises two opposed elongated members 170 which are substantially parallel and which may comprise a substantially L-Shaped frame structure. The two elongated members 170 run along the length of the trench, one on each side, and in opposed relation to each other. Each elongated member 170 comprises an upright portion 168 having a front surface 164, an opposite rear surface 166, a lower portion 177 having an underside surface 179 horizontally extending to termination in a distal edge 180. Each rib 42 is spaced along the elongated member 170 and includes an upstanding portion 45 which has an upper end 51, and an opposite lower end 47. The width of the elongated member 170 is less than one-half of the width of the trench, therefore a gap 52 is formed between the distal edges 180 which longitudinally extend along the length of the gap 52. A perforated bridge 15 having an upper surface 182, a lower surface 184 and a plurality of spacing surfaces 22 is placed in contacting relationship with the distal edges 180 of the opposed elongated members 170.

Because trenches vary in width, perforated bridge 15 was designed with rib spacing surfaces 22 of the same width, depth, shape and spacing as the separating means 16. The width of the perforated bridge 15 is determined by the width of the trench and the width of the elongated members 170. Between rib spacing surfaces 22 is a plurality of holes 17 through which any fluids may flow, particularly in the case of a puncture of the primary liner means 14. Any fluids so flowing may be detected by a fluid sensor 32 for leak detection. Rib spacing surfaces 22 on the perforated bridge 15 are aligned with ribs 42 on separating means 16.

Separating means 16 is formed of a rigid material such as fiberglass, plastic, stainless steel, coated steel or any other formable material. The basic shape will conform to the trench 11 into which it will be placed. In FIG. 1 and FIG. 2, the trench has a square bottom so the separating means 16 is squared in the outside corner 20. The separating means 16 might have a rounded or other shaped rearward side and will be shaped to fit the interior of the trench.

The separating means 16 may be of varying heights, widths, lengths, and thicknesses. Typically, the separating means 16 will be molded or formed to a specific size for the trench into which it is to be placed. The separating means 16 may be of relatively short lengths with space left between each unit to accommodate any expansion or contraction that might occur. Separating means 16 could also be continuous.

Ribs 42 are placed on the separating means 16 in a vertical orientation to define a rectangular cavity 186 between the separating means 16 and the primary liner means 14 so that a break in primary liner means 14 would allow fluids to migrate from the break, down the cavity 186 through holes 17 in the perforated bridge 15 to the bottom of the trench and to sensor 32. However, horizontal, rather than vertical, ribs with breaks would also allow migration of a leak to the area of sensor 32. The actual shape of the ribs could be rectangular, square, rounded or any other applicable shape, as would be obvious to one skilled in the art.

The thickness of ribs 42 and their distance apart is determined by the materials from which the primary liner means 14 and the separating means 16 are made. With many materials, significant expansion and contraction occurs as fluids pass through the trench at varying temperatures. Expansion and contraction also occurs when there are no fluids in the trench at all. One important purpose of this invention is to maintain a space between the primary liner means 14 and the separating means 16 when expansion or contraction occur. This is particularly important for the primary liner means 14. By properly spacing the ribs 42 of the proper thickness and shape, the expansion of the material in the primary liner means 14 will occur between the ribs in a rippling or "S" shaped or cupping way, minimizing the effects of the expansion in the overall trench, which could be hundreds of feet long.

Figure 3:
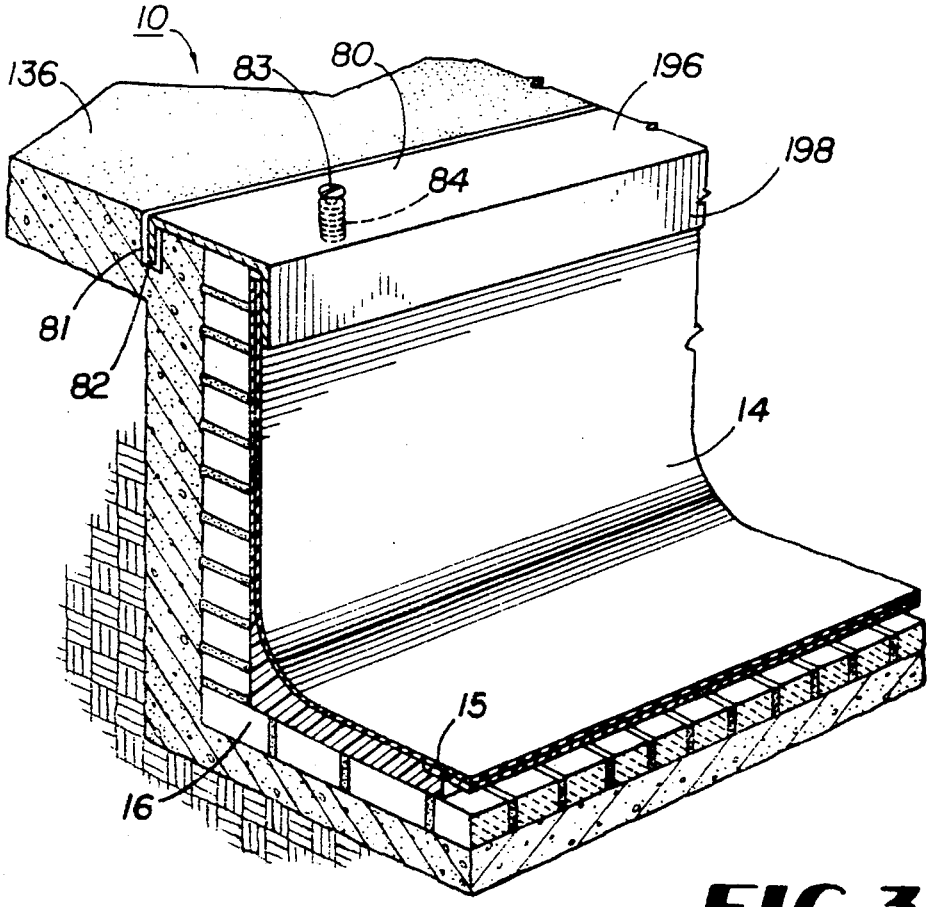
FIG. 3 is a partial perspective view of the trench assembly in which there are no frames, grates or covers.

FIG. 3 shows an embodiment of the trench with no frames, grates or covers within the trench wherein the holding means is substantially U-shaped. It comprises a horizontal member 196 having a first end with a first wall 82 depending therefrom and an opposed second end with a second wall 198 depending therefrom. The top surface 136 of the trench wall has an opening 81 therein to receive a portion of the first depending wall 82 and the second depending wall of horizontal member 196 overlies the upper portion of the primary liner 14 and the separating means 16. To line trench 11 or to turn trench 11 into a dual containment trench, the separating means 16 along with the perforated bridge 15 are put in place as shown in FIG. 2. U-shaped members 80 are fit against the separating means 16 and the primary liner 14 in a vertical fashion, leaving each enough room to move independently of one another.

The horizontal portion of the U-shaped member 80 is fastened to the surrounding surface with a bolt 83 extending from the surface into an expansion shield 84 holding the U-shaped member 80 in place. Sealants may be used in the opening 81 between the U-shaped member 80, the top surface 136, and between adjacent U-shaped members along the trench. In some instances, it may be necessary to remove material under the U-shaped member 80 in order to make the top of U-shaped member 80 level with the surface 136.

Figure 4:
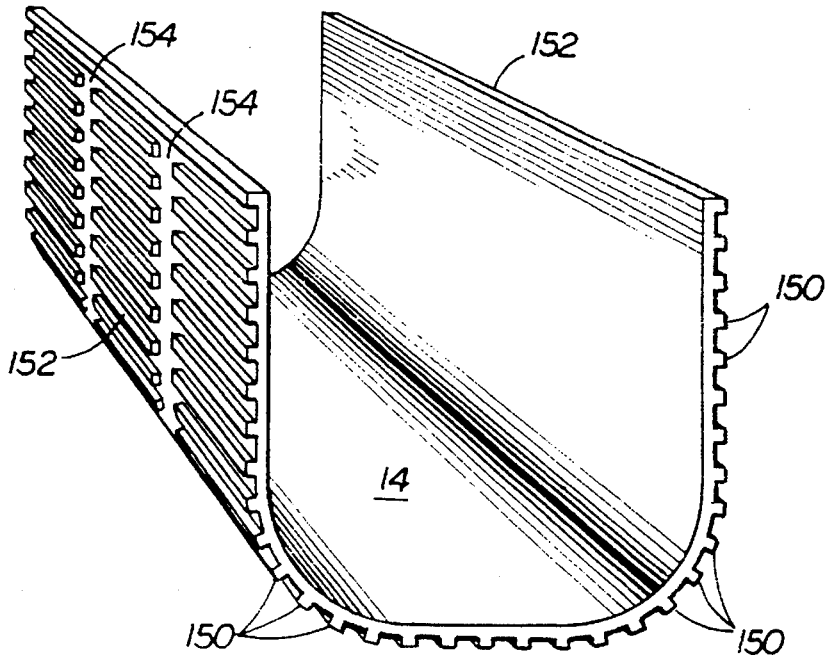
FIG. 4 is a perspective view of a primary wall means with a plurality of ribs disposed along its length.

FIG. 4 is an alternative embodiment in which the primary liner means 14 has a plurality of ribs 150 disposed horizontally on the exterior surface 152 of the primary liner means 14 along its length. A plurality of openings 154 in the ribs 150 may be placed along their length to allow for expansion and contraction and downward fluid drainage to a fluid sensing or detection unit. Actual shape of the ribs could be rectangular, square, rounded or any other applicable shape, as would be obvious to one skilled in the art.

FIG. 5 shows four variations of holding means 46, 48 and two variations of connecting members 140A, 140B. As shown in FIG. 5*a*, holding means 48 shows an anchor plate 100 which has a planar portion and is affixed to the upper portion of an existing trench wall (not shown) by leg members 108. A frame 188, may be removably attached to the anchor member 100 with a bolt 74 or other attaching means. Frame 188 is Z-shaped with a horizontal portion 190 having a first side 191 and a second opposing side 193. The first side 191 terminates in a depending portion 192 and the second side 193 terminates in an upright portion 194. The horizontal portion 190 overlies the anchor member 100 and depending portion 192 overlies the upper portion of the primary liner 14 and the separating means 16. A slotted spacer bar 140*a* which is held to the frame 188 with bolts, nuts, or threaded bores for receiving a bolt therethrough may be used to keep the opposing holding means 48 parallel one to another. FIG. 2 shows holding means 48 as shown in FIG. 5*a*.

Figure 5A:
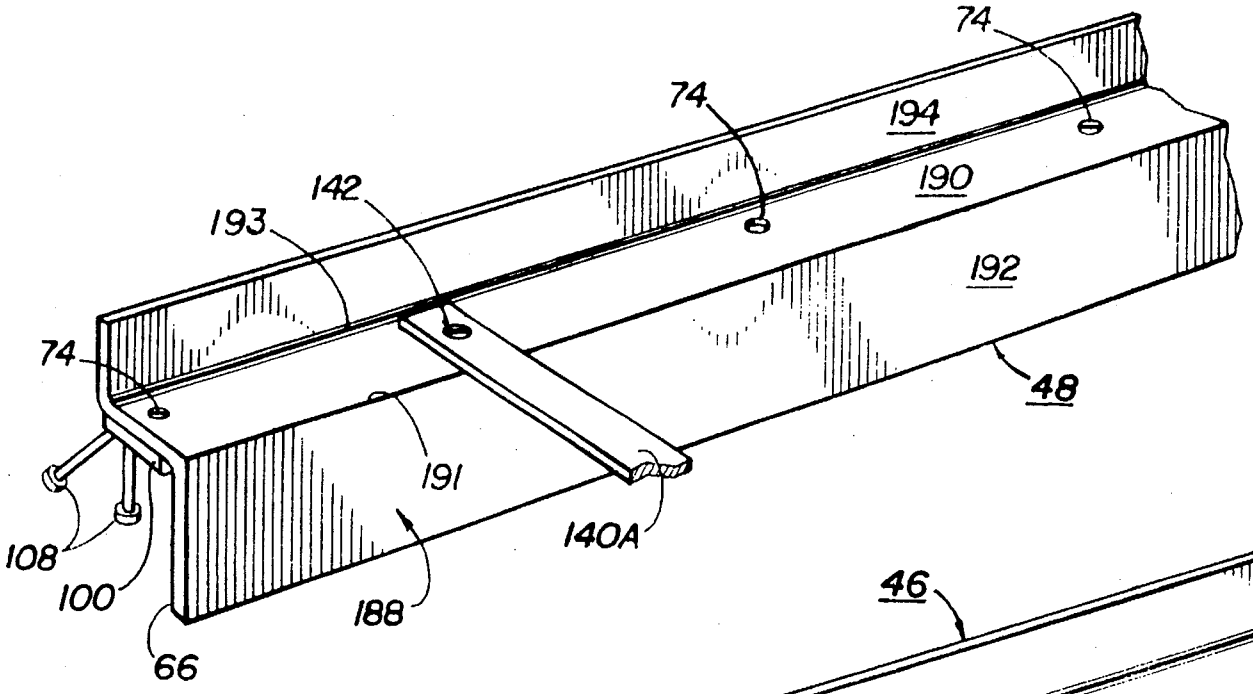
FIG. 5*a* and 5*b* are perspective views of the frame member in removable and non-removable configurations.
Figure 5B:
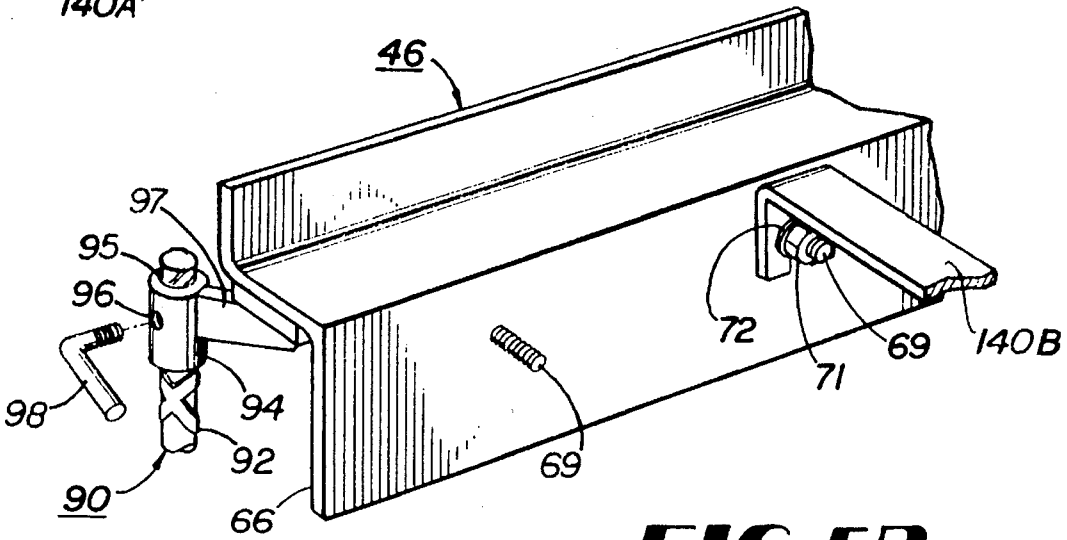

FIG. 5*b* shows holding means 46 comprising of an anchor member 100, which has a planar portion and is affixed to the upper portion of an existing trench wall (not shown) by an anchor stand 90. Anchor stand 90 comprises a supporting rod 92, a cylindrical collar 94 having a threaded bore 96 laterally extending therethrough and a longitudinally extending opening 95 for receiving the supporting rod 92, a bolt 98 which is threaded to match the threaded bore 96, a connecting member 97 attached to the collar 94. It is obvious that the rod 92, the collar 94, and its axial opening 95 need not be cylindrical in shape. The length of rod 92 will be determined by the maximum length which can be anchored into the cut-out trench opening. As in FIG. 5*a*, frame 188, may be removably attached to the anchor member 100 with a bolt 74 or other attaching means. A spacer bar 140*b* which is held to the frame 188 with bolts, nuts, or threaded bores for receiving a bolt therethrough may be used to keep the opposing holding means 46 parallel one to another.

Figure 5C:
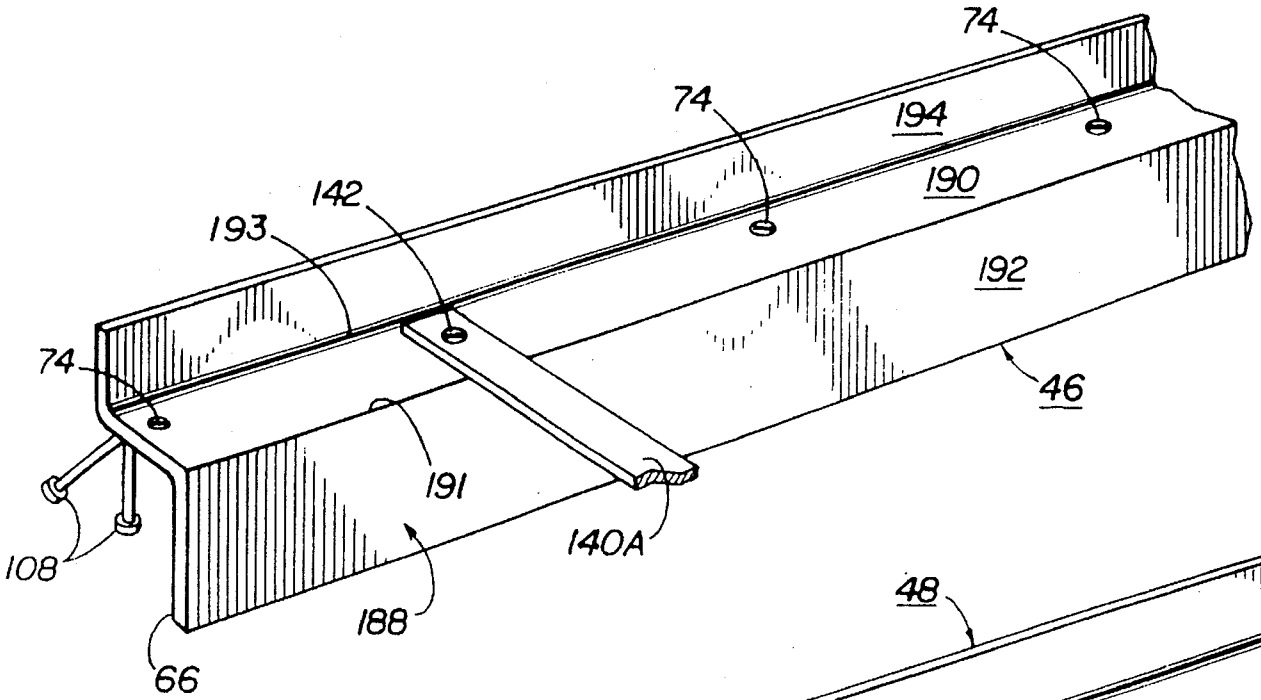
Figure 5D:
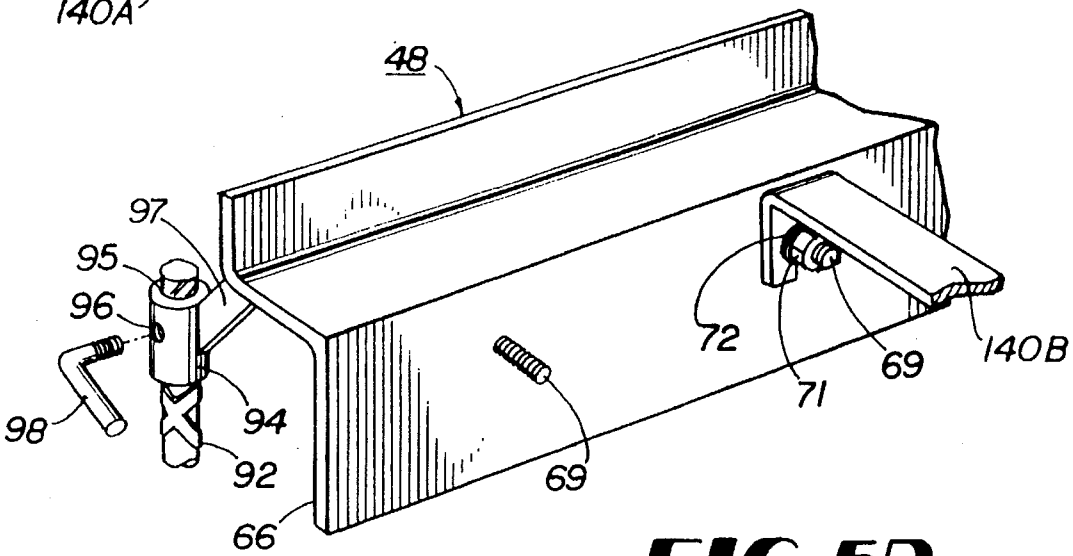

FIG. 5*c* and FIG. 5*d* show two other embodiments of holding means 46 48. Referring to FIG. 5*c*, frame 188 is not removably attached to an anchor plate as in FIG. 5*a*, but instead, frame 188 is directly attached to leg members 108. Likewise, in FIG. 5*d*, frame 188 is directly attached to the anchor stand 190.

Figure 6:
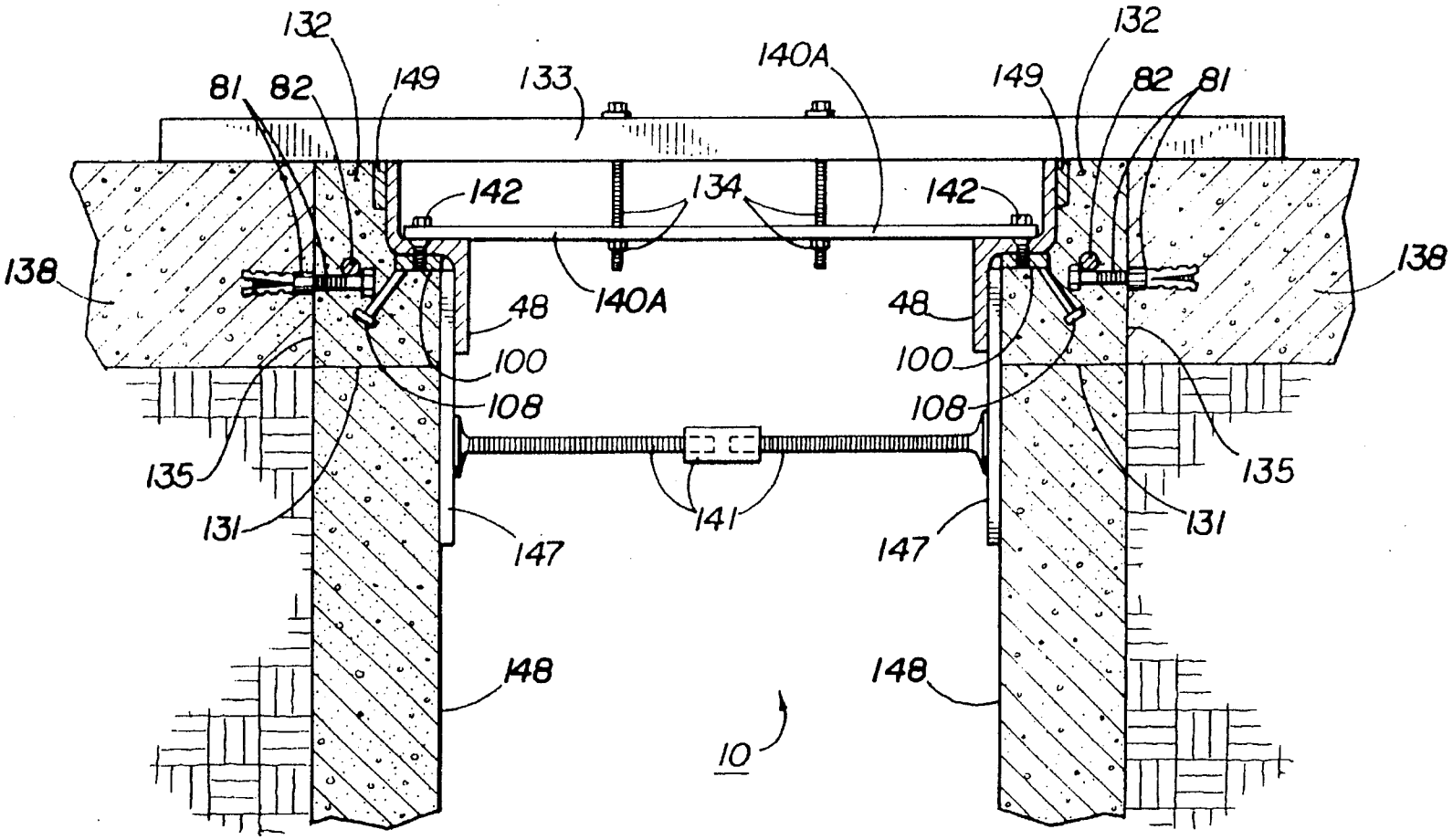
FIG. 6 is a cross-sectional view of a means to hold the frame assembly in position when pouring concrete or other material about it.

FIG. 6 illustrates a method of frame installation prior to relining a trench or conversion of a trench to dual containment. It is preferred to place two or more crossing members 133, which can be pieces of hanger material, such as wooden 4×4's or steel channels, across the trench for each frame member, and suspend the frames from these trench crossing members 133 and the spacer bars 140*a* or 140*b* (as shown in FIG. 5), using wire or nuts and bolts 134 to hold the frames at the proper finished elevation. A block 147 slightly thicker than primary liner 14 and separating means 16 and made of solid material is placed between the holding means 48 and the existing wall 148, and held firmly by spreaders 141 placed along the trench as needed. Expansion bolts 81 are attached to the existing concrete 138 at regular intervals along the vertical wall 135. Attached to the anchor bolts 81 is a reinforcing rod 82, preferably lying in a horizontal manner and attached firmly to the expansion bolts 81. Grout, or other material, is filled into notch 132 behind and below the holding means 48. As the material hardens, a groove 149 is formed behind the frame into which a sealant is later placed.

Once the filled material in the notch 132 has sufficiently hardened, the spreaders 141, the blocks 147, the crossing members 133 and the nuts and bolts 134 are removed, the spreader bars 140*a* or 140*b* are removed, and sections of the new material in the notch 132 are coated on the new top and face with a sealant that will withstand the fluid that will pass through the trench, if required.

INSTALLATION AND OPERATION

Referring to FIG. 6, the installation and the operation of the multi-walled trench system 10 is as follows: A vertical cut 135 in the concrete, bricks, or other existing material is made deep enough and far enough from the face of the existing trench 11 to remove any existing frame and to hold the replacement frame assembly 48 and the primary liner means 14 and the separating means 16. A horizontal cut 131 is made deep enough to meet the vertical cut 135 until any existing frame assembly can be removed, thus forming a notch 132 in the existing trench wall 11. As shown in FIG. 5, the new frame assemblies 48 are secured to each other by spreader bars 140*a* or 140*b*, held to the frames by bolts 142 or by nuts and bolts 69, 71. Referring to FIG. 6, bars made of strong pieces of wood such as 4×4's, steel channels or angle irons 133 are placed across the trench past the notch 132. The frame is centered over the trench 11 and securely attached by bolts and nuts 134, or wired securely, to crossing member 133 across the trench so that the top of the frame 48 fits snugly against the crossing members 133. A block 147 is placed between the frame and the existing wall 148, held firmly by a spreader 141. The block is slightly thicker than the thickness of the primary liner 14 and the separating means 16, so as to provide enough room for the primary liner means 14 and separating means 16 to move independently of each other during expansion or contraction and deep enough to more than cover the face of the notch 132. Grout or other material is filled into notch 132 behind and below frame assemblies 48. As the material hardens, a groove is formed behind the frame into which a sealant is later placed. Once the filled material has sufficiently hardened, the spreaders 140*a*, 140*b* are removed, the blocks 147 and the nuts and bolts 134, or wires if used, are removed, the crossing members 133 are removed, and notch 132 is coated on the new top and face with a sealant that will withstand the fluid that will pass through the trench, if required. The same general method is used with frame 46, as shown in FIG. 5*b*.

The frames 48 are removed from anchor members 100, if used, and placed adjacent to the removal area. Primary separating walls 16 are put in place within the trench on both sides, perforated bridge 15 is put in place and the primary liner means 14 is placed inside the separating means 16 so that the walls of each are in engagement with each other. The frame 48 is put in place on the anchor member 100 with the separating means 16 and primary liner means 14 behind the frame. When all frames are in place, a sealant, such as a polysulfide, is used to fill the groove 149 behind the frame and in the space between flames abutting each other and under the bolts 74 used to fasten the frame 48 to its anchoring member 100.

Where frame 46 is used, it cannot be removed after it is set in place as with frame 48. Instead, the separating means 16 are pushed up from underneath frames 46 until in place on both sides of the trench. Perforated bridge 15 is placed between, and aligned with, the elongated members 170. The primary liner means 14 is placed upon the separating means 16 and worked up behind frame 46 against side 66. Grates or covers may then be placed in the frames, with the trench system then being ready for use.

The above embodiments are given as illustrative examples and are not intended to impose any limitations on the invention. It will be readily appreciated that many deviations may be made from the specific embodiments disclosed in this specification without departing from the invention. Accordingly it is intended to cover all such modifications as within the scope of this invention.

What is claimed is:

1. A trench liner system for lining a trench having at least two walls and a bottom, comprising:

a. primary liner means, with an interior surface and an exterior surface, extending along the length of the trench;

b. means for separating the primary liner means from the trench walls, having a first surface open to the interior of the trench and an opposed second surface along the length of the trench;

c. means disposed between the primary liner means and the separating means for spacing the exterior surface of the primary liner means from the first surface of the separating means, wherein the primary liner means and the separating means are allowed to expand and contract independently from each other; and d. means for holding the primary liner means and the separating means to the trench walls.

2. The system of claim 1 wherein the separating means comprises a plurality of pairs of elongated members, each member having a from surface and an opposite rear surface an upper edge and a lower edge, the members being disposed along the trench such that the rear surface of each elongated member is in contact with the trench walls and trench bottom and such that the lower edges of each of the pairs of elongated members are in opposed relationship.

3. The system of claim 2 wherein the separating means further comprises a bridge, with an upper surface and a lower surface, in contacting relationship with the distal edges of the opposed elongated members.

4. The system of claim 3 wherein the separating means comprises a plurality of ribs spaced along the first surface of the separating means, so that the exterior surface of the primary liner means is supported by the ribs and a cavity is formed between the exterior surface of the primary liner means and the first surface of the separating means between the ribs.

5. The system of claim 3 wherein the separating means comprises a plurality of ribs spaced along the exterior surface of the primary liner means, so that a cavity is formed between the exterior surface of the primary liner means and the trench walls and bottom.

6. The system of claim 5 wherein the ribs are positioned horizontally along the exterior surface of the primary liner means and wherein the ribs have a plurality of openings therethrough to allow for the downward flow of fluid.

7. The system of claim 2 wherein the length of each lower portion is less than one-half the width of the bottom of the trench so that a gap is formed between the distal edges of the lower portions.

8. The system of claim 7 wherein the bridge has a plurality of holes passing therethrough from the upper surface through the lower surface so that the gap is capable of being in fluid communication with the first surface of the separating means.

9. The system of claim 8 further comprising means for detecting fluid flowing into the gap through the holes.

10. The system of claim 9 further wherein the detecting means comprises an electronic fluid sensor.

11. The system of claim 1, wherein the interior surface of the primary liner has an upper portion and wherein the holding means is substantially U-shaped and comprises a horizontal member having a first end with a first wall depending therefrom and an opposed second end with a second wall depending therefrom, the top surface of the trench wall having an opening therein to receive a portion of the first depending wall and the second depending wall overlying the upper portion of the liner.

* * * * *

UNITED STATES PATENT AND TRADEMARK OFFICE

CERTIFICATE OF CORRECTION

PATENT NO. : 5,573,351

DATED : November 12, 1996

INVENTOR(S) : John V. Beamer

It is certified that error appears in the above-indentified patent and that said Letters Patent is hereby corrected as shown below:

Column 3 line 52, please delete "FIG. 5a and 5b are" and insert therefor: --FIGS. 5a and 5d are--.

Signed and Sealed this

Thirteenth Day of May, 1997

*Attest:*

BRUCE LEHMAN

*Attesting Officer*

*Commissioner of Patents and Trademarks*